US011395932B1

(12) United States Patent
Johnson

(10) Patent No.: US 11,395,932 B1
(45) Date of Patent: Jul. 26, 2022

(54) FIRE-EXTINGUISHING TARP

(71) Applicant: Joyce Ann Johnson, Jacksonville, FL (US)

(72) Inventor: Joyce Ann Johnson, Jacksonville, FL (US)

( * ) Notice: Subject to any disclaimer, the term of this patent is extended or adjusted under 35 U.S.C. 154(b) by 114 days.

(21) Appl. No.: 16/984,264

(22) Filed: Aug. 4, 2020

(51) Int. Cl.
*A62C 3/02* (2006.01)
*A62C 2/04* (2006.01)

(52) U.S. Cl.
CPC ..... *A62C 3/0257* (2013.01); *A62C 2/04* (2013.01)

(58) Field of Classification Search
CPC ..... A62C 3/0257; A62C 2/04
USPC ..... 169/49
See application file for complete search history.

(56) References Cited

U.S. PATENT DOCUMENTS

D190,631 S * 6/1961 Miller ..... D25/13
3,635,290 A * 1/1972 Schneider ..... A62C 3/0257 169/48
4,311,199 A * 1/1982 Elias ..... A62B 3/00 256/65.01
5,146,996 A * 9/1992 Gainer, Jr. ..... B64D 1/00 169/53
5,407,301 A * 4/1995 Lydiard ..... E02B 15/08 405/63
5,423,150 A * 6/1995 Hitchcock ..... A62C 3/0214 169/56
5,860,251 A * 1/1999 Gleich ..... E04H 9/16 52/DIG. 14
5,944,114 A * 8/1999 Farley ..... A62C 3/0257 169/48
6,364,026 B1 * 4/2002 Doshay ..... G08B 17/005 169/56
6,695,068 B2 * 2/2004 Woodall ..... B63B 21/56 169/48
8,297,371 B1 * 10/2012 Musser, Jr. ..... A62C 2/10 169/48
8,997,884 B1 * 4/2015 Morlier ..... A62C 3/0257 169/48
9,091,513 B2 * 7/2015 Shand ..... F41H 13/0006
9,174,074 B2 * 11/2015 Medina ..... A62C 2/06
9,486,656 B2 * 11/2016 Hutton ..... A62C 3/0257
11,185,724 B1 * 11/2021 Beard ..... B64D 1/16
11,225,326 B2 * 1/2022 Thomas ..... B64C 15/14
2002/0050534 A1 * 5/2002 Woodall ..... B63B 21/56 239/328
2004/0000409 A1 * 1/2004 Abbott ..... A01G 23/095 169/53
2005/0139363 A1 * 6/2005 Thomas ..... A62C 3/025 169/72

(Continued)

*Primary Examiner* — Joseph A Greenlund
(74) *Attorney, Agent, or Firm* — Kyle A. Fletcher, Esq.

(57) ABSTRACT

The fire extinguishing tarpaulin is configured for use extinguishing a chemical combustion reaction in an area of conflagration. The fire extinguishing tarpaulin comprises a fire tarpaulin, a rocket system, and an aircraft. The fire tarpaulin forms a gas impermeable barrier that limits the chemical combustion by limiting access to the oxygen required to sustain the chemical combustion reaction. The rocket system is a propulsion system that propels the fire tarpaulin to the chemical combustion reaction. The aircraft is a vehicle used: a) as a launching platform to deliver the fire tarpaulin to the chemical combustion reaction; and, b) a vehicle to subsequently recover the fire tarpaulin for future use.

18 Claims, 6 Drawing Sheets

(56) References Cited

U.S. PATENT DOCUMENTS

| | | | | |
|---|---|---|---|---|
| 2009/0194297 | A1* | 8/2009 | Ortiz Teruel | B32B 29/02 169/50 |
| 2009/0266567 | A1* | 10/2009 | Musser, Jr. | A62C 2/06 169/70 |
| 2010/0300707 | A1* | 12/2010 | Kolios | A62C 3/0257 169/48 |
| 2010/0318242 | A1* | 12/2010 | Jacobsen | B64D 1/02 701/25 |
| 2012/0067600 | A1* | 3/2012 | Bourakov | A62C 3/0257 169/49 |
| 2015/0314153 | A1* | 11/2015 | Yin | F41B 11/68 169/36 |
| 2016/0339280 | A1* | 11/2016 | Sexton-Finck | A62C 3/025 |
| 2021/0269151 | A1* | 9/2021 | Bartz | A62C 3/0257 |
| 2022/0001222 | A1* | 1/2022 | Dor | B64D 1/22 |

* cited by examiner

FIRE-EXTINGUISHING TARP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fire prevention including area conflagrations, more specifically, a fire tarpaulin. (A62C3/0257)

SUMMARY OF INVENTION

The fire extinguishing tarp is configured for use extinguishing a chemical combustion reaction in an area of conflagration. The fire extinguishing tarp may also be referred to as a fire extinguishing tarpaulin, which comprises a fire tarpaulin, a rocket system, and an aircraft. The fire tarpaulin forms a gas impermeable barrier that limits the chemical combustion by limiting access to the oxygen required to sustain the chemical combustion reaction. The rocket system is a propulsion system that propels the fire tarpaulin to the chemical combustion reaction. The aircraft is a vehicle used: a) as a launching platform to deliver the fire tarpaulin to the chemical combustion reaction; and, b) a vehicle to subsequently recover the fire tarpaulin for future use.

These together with additional objects, features and advantages of the fire extinguishing tarpaulin will be readily apparent to those of ordinary skill in the art upon reading the following detailed description of the presently preferred, but nonetheless illustrative, embodiments when taken in conjunction with the accompanying drawings.

In this respect, before explaining the current embodiments of the fire extinguishing tarpaulin in detail, it is to be understood that the fire extinguishing tarpaulin is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fire extinguishing tarpaulin.

It is therefore important that the claims be regarded as including such equivalent construction insofar as they do not depart from the spirit and scope of the fire extinguishing tarpaulin. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
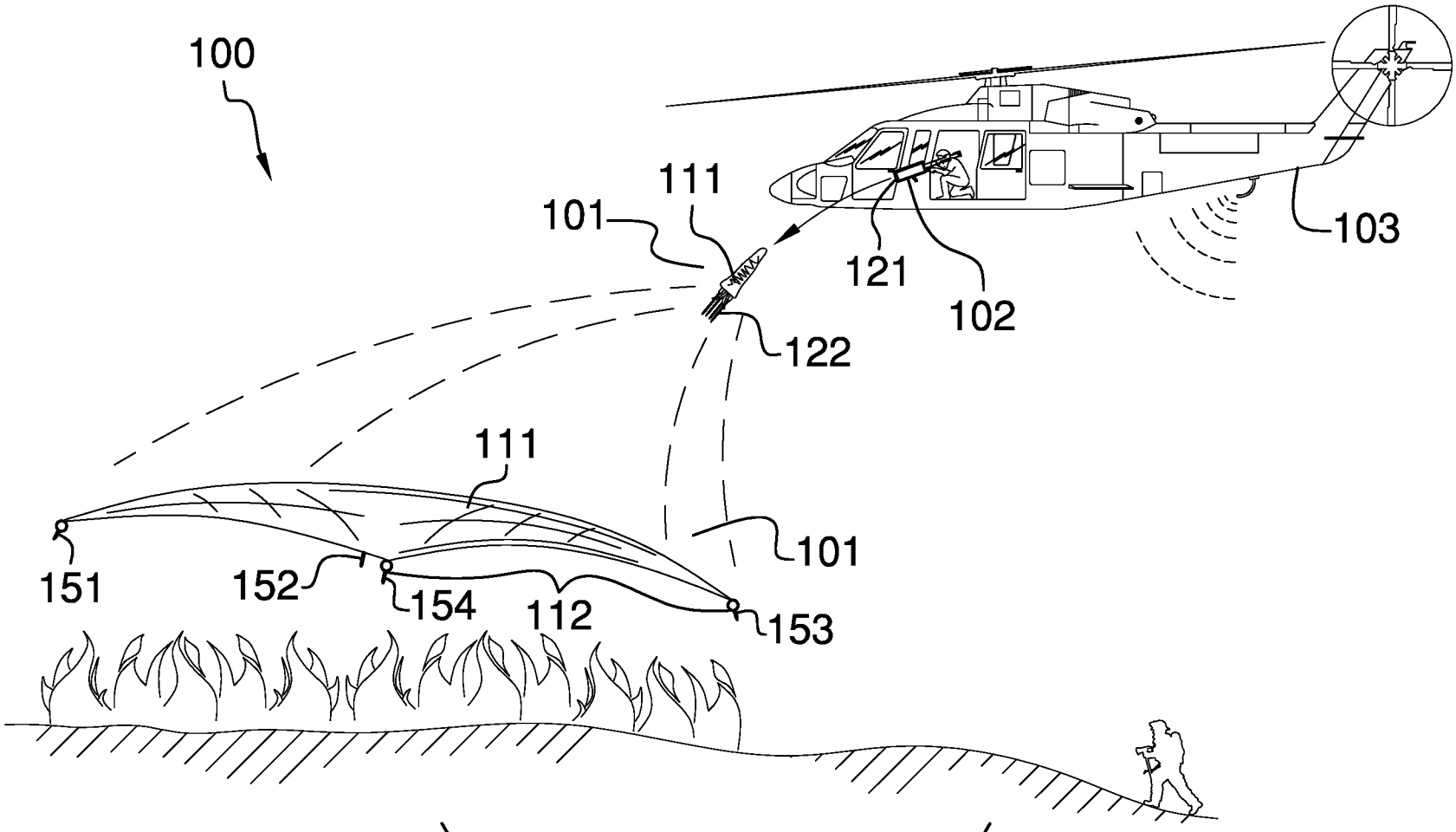
FIG. 1 is an in-use view of an embodiment of the disclosure.
Figure 2:
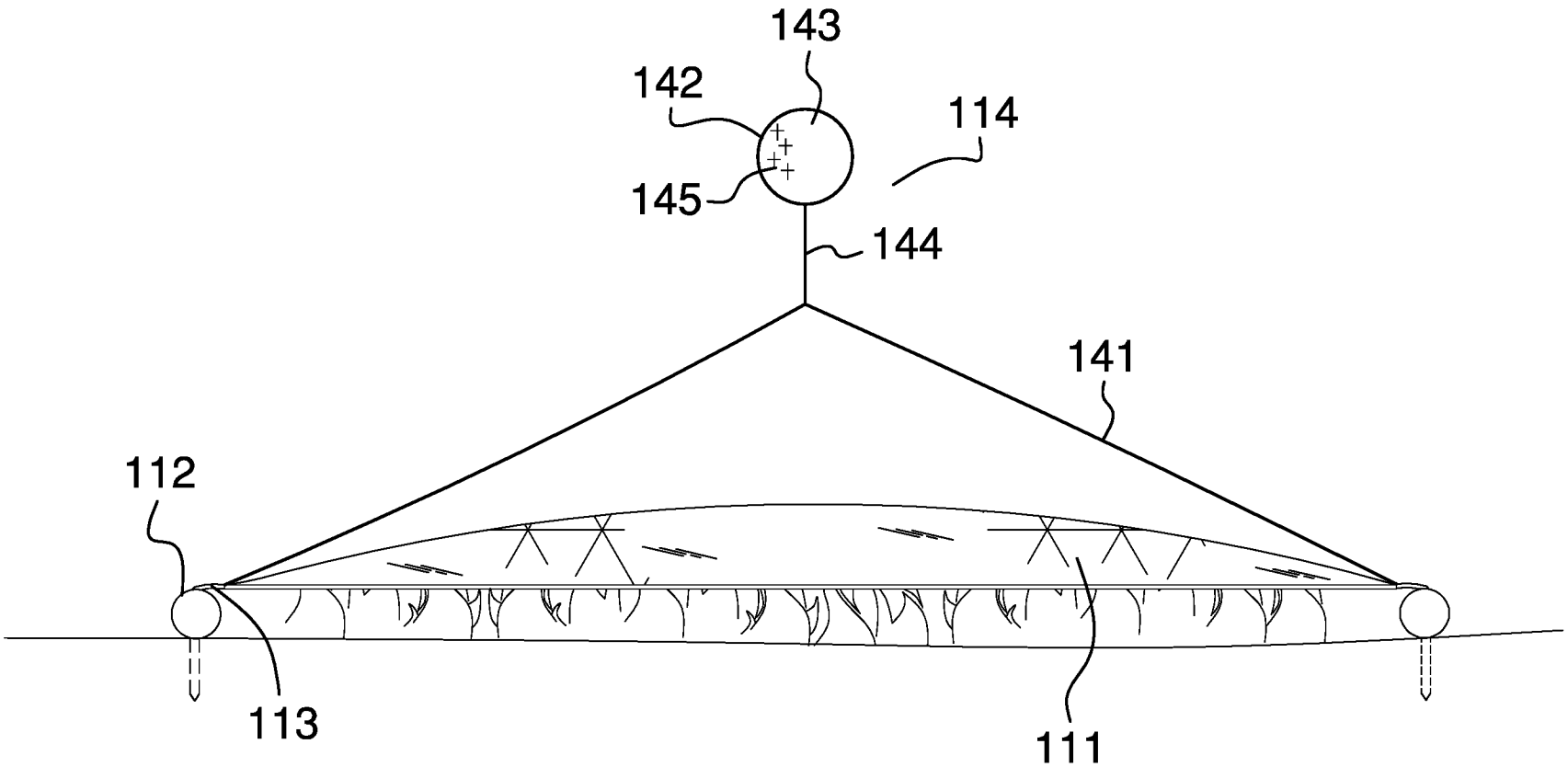
FIG. 2 is a front view of an embodiment of the disclosure.
Figure 3:
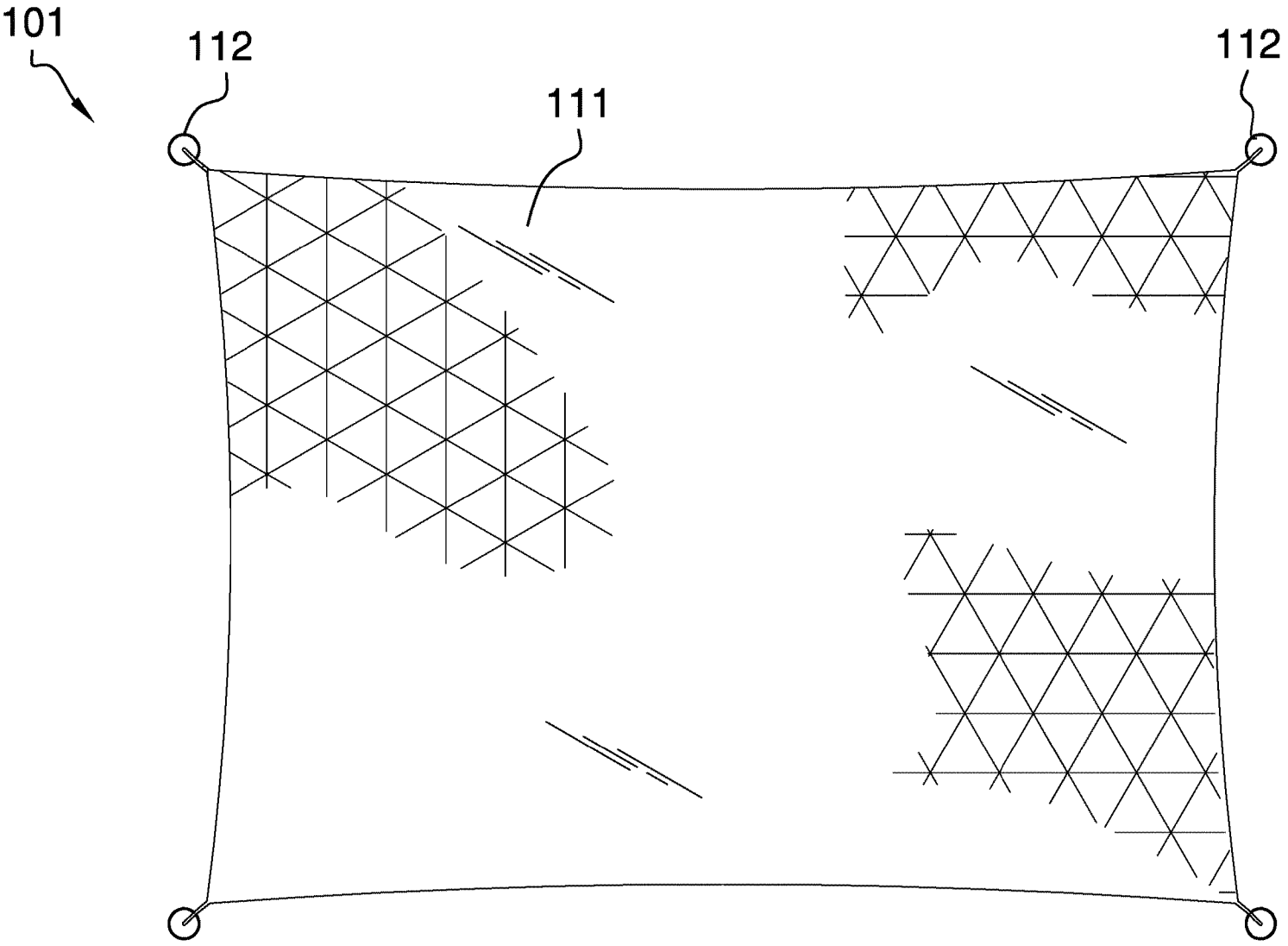
FIG. 3 is a top view of an embodiment of the disclosure.
Figure 4:
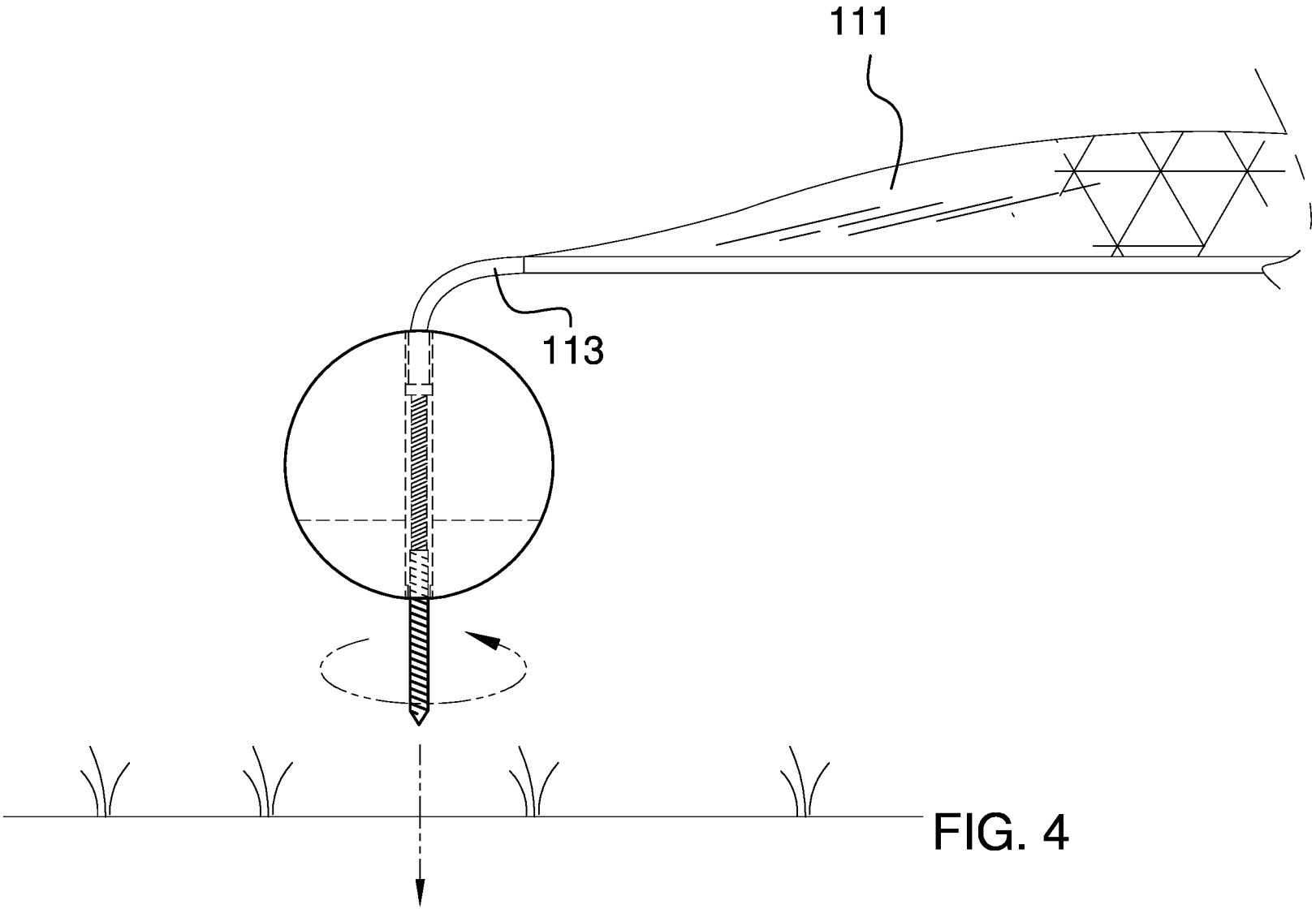
FIG. 4 is a side view of an embodiment of the disclosure.
Figure 5:
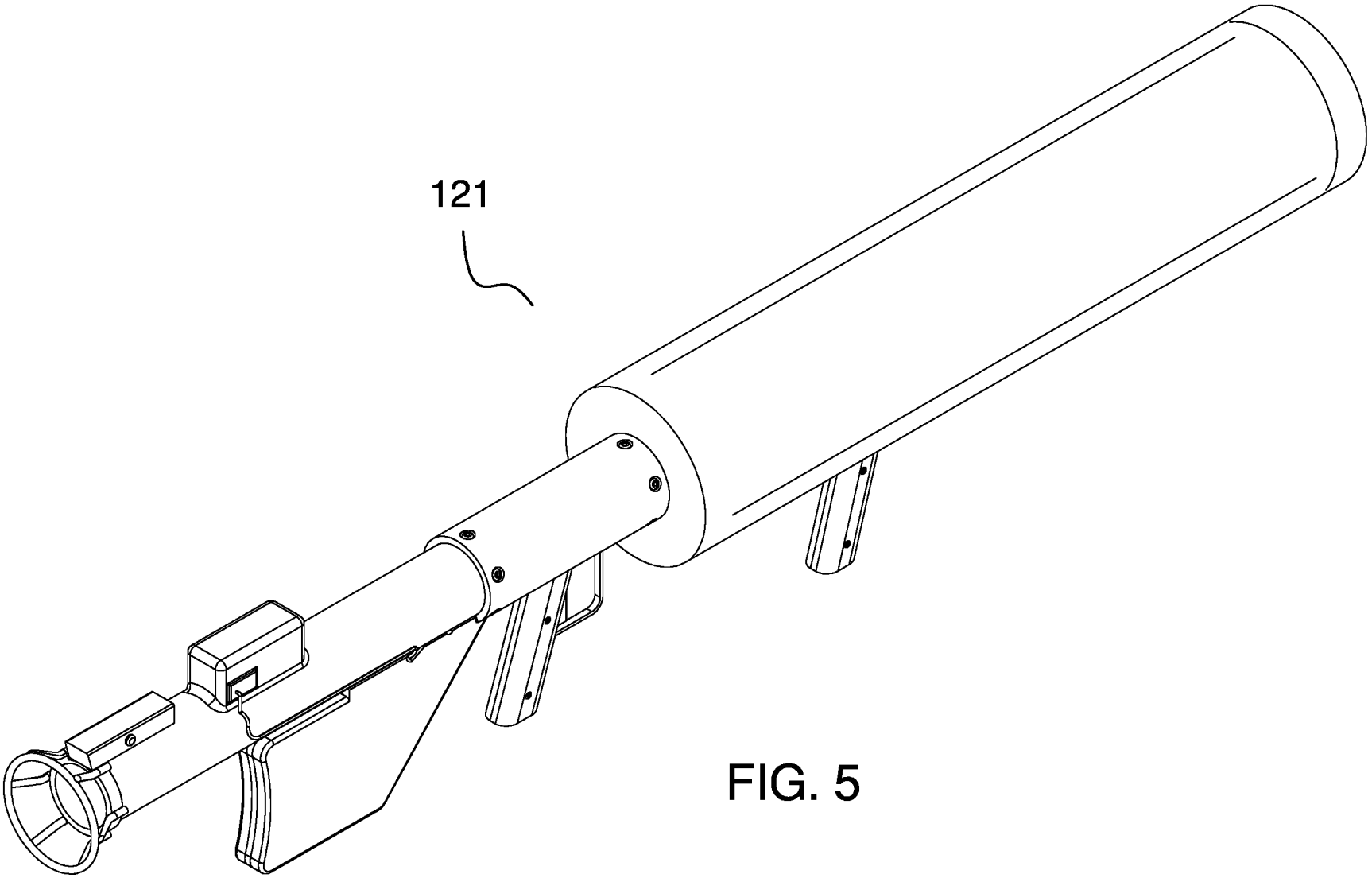
FIG. 5 is a detail view of an embodiment of the disclosure.
Figure 6:
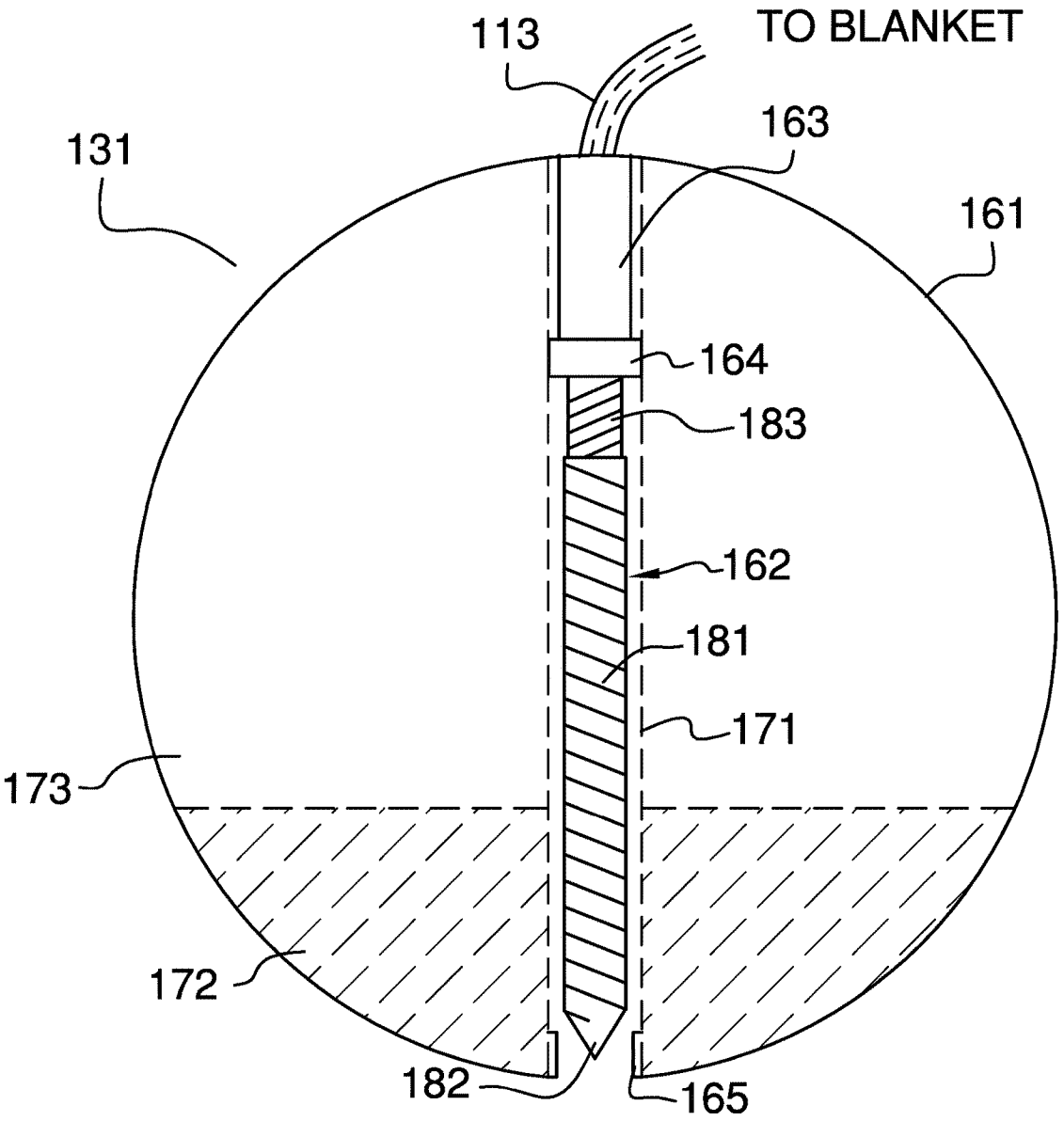
FIG. 6 is a detail view of an embodiment of the disclosure.

Detailed reference will now be made to one or more potential embodiments of the disclosure, which are illustrated in FIGS. 1 through 6.

The fire extinguishing tarpaulin 100 (hereinafter invention) is configured for use extinguishing a chemical combustion reaction in an area of conflagration. The invention 100 comprises a fire tarpaulin 101, a rocket system 102, and an aircraft 103. The fire tarpaulin 101 forms a gas impermeable barrier that limits the chemical combustion by limiting access to the oxygen required to sustain the chemical combustion reaction. The rocket system 102 is a propulsion system that propels the fire tarpaulin 101 to the chemical combustion reaction. The aircraft 103 is a vehicle used: a) as a launching platform to deliver the fire tarpaulin 101 to the chemical combustion reaction; and, b) a vehicle to subsequently recover the fire tarpaulin 101 for future use.

The aircraft 103 is a mechanical structure. The aircraft 103 forms the platform that launches the fire tarpaulin 101 to the site of the chemical combustion reaction. The aircraft 103 subsequently recovers the fire tarpaulin 101. The aircraft 103 is defined elsewhere in this disclosure.

The rocket system 102 is a mechanical structure. The rocket system 102 is a propulsion system that propels the fire tarpaulin 101 to the site of the chemical combustion reaction. The rocket system 102 comprises a rocket launcher 121 and a plurality of propulsion devices 122.

The rocket launcher 121 is a mechanical structure. The aircraft 103 contains the rocket launcher 121. The rocket launcher 121 contains the fire tarpaulin 101 and the plurality of propulsion devices 122. The rocket launcher 121 aims the fire tarpaulin 101 and the plurality of propulsion devices 122 at the chemical combustion reaction. The rocket launcher 121 discharges the fire tarpaulin 101 and the plurality of propulsion devices 122 from the aircraft 103.

Each of the plurality of propulsion devices 122 attaches to the fire tarpaulin 101. Each of the plurality of propulsion devices 122 provides a motive force that accelerates the fire tarpaulin 101 towards the chemical combustion reaction after the fire tarpaulin 101 and the plurality of propulsion devices 122 have been discharged from the aircraft 103. The plurality of propulsion devices 122 is a mechanical device that discharges a propellant used to accelerate the fire tarpaulin 101 towards the chemical combustion reaction.

The fire tarpaulin 101 is a mechanical structure. The fire tarpaulin 101 is formed from non-combustible materials. The rocket system 102 transports the fire tarpaulin 101 to the location of a chemical combustion reaction. The fire tarpaulin 101 forms a gas impermeable barrier over the chemical combustion reaction. By covering the chemical combustion reaction, the fire tarpaulin 101 limits the chemical combustion reaction process. The fire tarpaulin 101 is a self-anchoring structure. By self-anchoring is meant that the fire tarpaulin 101 anchors itself to the ground such that the position of the fire tarpaulin 101 remains fixed. The ground and the chemical combustion reaction are defined elsewhere in this disclosure.

The fire tarpaulin 101 comprises a master sheeting 111, a plurality of anchors 112, a plurality of anchor cords 113, and a recovery structure 114. The plurality of anchor cords 113 and the recovery structure 114 attach to the master sheeting 111. The plurality of anchor cords 113 attach the plurality of anchors 112 to the master sheeting 111.

The master sheeting 111 is a flexible sheeting structure. The master sheeting 111 is formed from a foil. In the first potential embodiment of the disclosure, the master sheeting 111 is formed from aluminum. The master sheeting 111 forms a gas impermeable barrier that inhibits the access of chemical combustion reaction to atmospheric oxygen which limits the ability of the chemical combustion reaction to continue. The master sheeting 111 forms the gas impermeable barrier by laying flat over the chemical combustion reaction.

Each of the plurality of anchors 112 is a mechanical structure. Each of the plurality of anchors 112 physically anchors itself to the ground. Each of the plurality of anchors 112 forms an anchor point used to anchor the master sheeting 111 to a fixed position on the ground. The plurality of anchors 112 comprises a collection of individual anchors 131.

Each individual anchor 131 is a mechanical structure. Each individual anchor 131 is identical. Each individual anchor 131 lands on the ground. The individual anchor 131 rotates to a previously determined orientation relative to the ground. The individual anchor 131 discharges an auger 162 that anchors the individual anchor 131 to the ground. The anchor cord selected from the plurality of anchor cords 113 that is associated with the individual anchor 131 anchors the weighted sphere 161 to the ground. The individual anchor 131 comprises a weighted sphere 161, an auger 162, a compressed acceleration gas 163, an inertial sensor 164, and a brake plate 165.

The weighted sphere 161 is a spherical structure. The weighted sphere 161 is a rigid structure. The weighted sphere 161 forms a shell that contains the auger 162, the compressed acceleration gas 163, and the brake plate 165. The weighted sphere 161 is formed with all apertures and form factors necessary to allow the weighted sphere 161 to accommodate the use and operation of the auger 162, the compressed acceleration gas 163, and the brake plate 165. Methods to form a weighted sphere 161 suitable for the purposes described in this disclosure are well-known and documented in the mechanical arts.

The density of the weighted sphere 161 is not uniform throughout the volume of the spherical structure of the weighted sphere 161. The interaction between the force of gravity and the density variations within the weighted sphere 161 cause the weighted sphere 161 to rotate on the ground into a fixed orientation relative to the ground. Once properly oriented, the auger 162 anchors the weighted sphere 161 to the ground. The weighted sphere 161 comprises an auger 162 barrel 171, a major spherical section 172, and a minor spherical section 173.

The auger 162 barrel 171 is a negative space that is formed within the weighted sphere 161. The auger 162 barrel 171 has a prism-shaped structure. The position of the auger 162 barrel 171 is such that the center axis of the auger 162 barrel 171 aligns with both the center of the spherical structure of the weighted sphere 161 and with the center of mass of the minor spherical section 173. The auger 162 barrel 171 contains the auger 162. The auger 162 barrel 171 contains the compressed acceleration gas 163. The auger 162 barrel 171 contains the inertial sensor 164. The brake plate 165 mounts in the auger 162 barrel 171. The compressed acceleration gas 163 propels the auger 162 out of the auger 162 barrel 171.

The major spherical section 172 is a spherical section formed in the weighted sphere 161. The terms sphere and spherical section are defined elsewhere in this disclosure. The major spherical section 172 is further defined with a first density.

The minor spherical section 173 is a spherical section formed in the weighted sphere 161. The terms sphere and spherical section are defined elsewhere in this disclosure. The minor spherical section 173 is matched to the major spherical section 172 such that the major spherical section 172 and the minor spherical section 173 combine to form the full weighted sphere 161. The minor spherical section 173 is further defined with a second density. The second density of the material that forms the minor spherical section 173 is greater than the first density of the material that forms the major spherical section 172.

The density difference between the materials that form the major spherical section 172 and the minor spherical section 173 are selected such that the force of gravity will rotate the weighted sphere 161 into the proper orientation. The proper orientation of the weighted sphere 161 is set such that a line through both from the center of the weighted sphere 161 and the center of mass of the minor spherical section 173 will be parallel to the force of gravity.

The auger 162 is a helical structure. The auger 162 is contained within the auger 162 barrel 171 of the weighted sphere 161. The auger 162 is a rotating structure. After the weighted sphere 161 has rotated into the proper orientation, the auger 162 is propelled out of the auger 162 barrel 171 of the weighted sphere 161 into the ground. The auger 162 comprises an auger 162 shaft 181, an auger 162 spit 182, and a tailfin structure 183.

The auger 162 shaft 181 is a prism-shaped structure. The auger 162 shaft 181 is a helical structure. The auger 162 shaft 181 forms a structure that removes material away from the auger 162 spit 182 as the auger 162 is driven into the ground.

The auger 162 spit 182 is a pyramid shaped structure. The auger 162 spit 182 attaches to a congruent end of the auger 162 shaft 181 to form a composite prism structure. The combination of the auger 162 shaft 181 and the auger 162 spit 182 forms a spit structure that moves loose matter out of the way as the auger 162 is driven into the ground by the compressed acceleration gas 163. The auger 162 and the spit are defined elsewhere in this disclosure.

The tailfin structure 183 is a mechanical structure that forms an airfoil. The tailfin structure 183 attaches to the congruent end of the auger 162 shaft 181 that is distal from the auger 162 spit 182. The tailfin structure 183 attaches the auger 162 shaft 181 to the inertial sensor 164. The release of the compressed acceleration gas 163 provides the motive forces necessary to allow the tailfin structure 183 to rotate the auger 162 as the compressed acceleration gas 163 drives the auger 162 into the ground. The auger 162, the spit, and the airfoil are defined elsewhere in this disclosure.

The compressed acceleration gas 163 rotates the auger 162 as it propels the auger 162 such that the rotation of the auger 162 bores the auger 162 into the ground. Once secured into the ground, the auger 162 anchors the weighted sphere 161 into the ground. The compressed acceleration gas 163 is compressed nitrogen. The release of the compressed acceleration gas 163 provides the motive force that propels and rotates the auger 162 into the ground. The compressed acceleration gas 163 mounts in the auger 162 barrel 171 of the weighted sphere 161 such that the release of the compressed acceleration gas 163 propels and rotates the auger 162 out of the auger 162 barrel 171.

The inertial sensor 164 is an interlock device. The inertial sensor 164 forms a valve structure that interfaces the compressed acceleration gas 163 with the auger 162. Specifically, the inertial sensor 164 detects the decelerative forces generated by the landing of the weighted sphere 161 on the ground. The inertial sensor 164 releases the compressed acceleration gas 163 after the inertial sensor 164 has detected the appropriate deceleration.

The brake plate 165 is a mechanical structure that mounts within the auger 162 barrel 171 of the weighted sphere 161. The brake plate 165 is a ring structure that is sized to allow the auger 162 spit 182 and the auger 162 shaft 181 to escape the auger 162 barrel 171 of the weighted sphere 161 but that traps the tailfin structure 183 within the auger 162 barrel 171. The brake plate 165 physically secures the auger 162 after it has been deployed such that the auger 162 anchors the weighted sphere 161 to the ground.

The plurality of anchors 112 further comprises a first anchor 151, a second anchor 152, a third anchor 153, and a fourth anchor 154. The first anchor 151 is an anchor selected from the plurality of anchors 112. The first anchor 151 attaches to the perimeter of the master sheeting 111. The second anchor 152 is an anchor selected from the plurality of anchors 112. The second anchor 152 attaches to the perimeter of the master sheeting 111. The third anchor 153 is an anchor selected from the plurality of anchors 112. The third anchor 153 attaches to the perimeter of the master sheeting 111. The fourth anchor 154 is an anchor selected from the plurality of anchors 112. The fourth anchor 154 attaches to the perimeter of the master sheeting 111.

Each of the plurality of anchor cords 113 is a cord. There is a one to one correspondence between the plurality of anchor cords 113 and the plurality of anchors 112. Each of the plurality of anchor cords 113 physically anchors the master sheeting 111 into a fixed position by attaching the master sheeting 111 to an anchor selected from the plurality of anchors 112. Each of the plurality of anchor cords 113 is a flexible structure formed from a metal wire.

The recovery structure 114 is a mechanical structure. The recovery structure 114 attaches to the master sheeting 111. The recovery structure 114 forms a structure that allows a tailhook deployed from the aircraft 103 to capture the fire tarpaulin 101 after the chemical combustion reaction has been extinguished. The recovery structure 114 comprises a recovery cord 141 and a balloon 142.

The recovery cord 141 is a cord that attaches across the face of the master sheeting 111. The recovery cord 141 is formed from a metal wire. The recovery cord 141 forms a linear structure that hooks onto the tailhook of the aircraft 103 as the aircraft 103 flies over the fire tarpaulin 101 during the recovery process.

The balloon 142 is a flexible bladder structure. The balloon 142 forms a floating structure within the atmosphere. The balloon 142 attaches to the recovery cord 141 such that the balloon 142 elevates the recovery cord 141 above the master sheeting 111. The elevation of the recovery cord 141 above the master sheeting 111 allows the aircraft 103 to capture the fire tarpaulin 101 during the recovery process. The balloon 142 further comprises an aluminum sheath 143, a lift cord 144, and a compressed lift gas 145.

The aluminum sheath 143 is a bladder. The aluminum sheath 143 contains the compressed lift gas 145 under pressure during the recovery process. The aluminum sheath 143 forms a floating structure within the atmosphere such that the aluminum sheath 143 provides the motive forces necessary to raise the recovery cord 141 above the master sheeting 111. The lift cord 144 is a cord. The lift cord 144 is formed from a metal wire. The lift cord 144 physically attaches the aluminum sheath 143 to the recovery cord 141. The compressed lift gas 145 is a compressed gas. The compressed lift gas 145 is stored under pressure in the aluminum sheath 143. In the first potential embodiment of the disclosure, the compressed lift gas 145 is helium.

The following definitions were used in this disclosure:

Aircraft: As used in this disclosure, an aircraft is a vehicle that moves through the atmosphere (or a vacuum) without requiring a structural load path to a supporting surface.

Airfoil: As used in this disclosure, an airfoil is a curved structure. The airfoil is designed to move through a fluid. The design of the curvature of the airflow manipulates the frictional forces created by the flow of the fluid around the airflow such that mechanical work is performed by the airfoil.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aluminum: As used in this disclosure, aluminum is a metal. Aluminum (CAS 7429-90-5) is element 13 in the periodic table and has a designated abbreviation of Al.

Anchor: As used in this disclosure, anchor means to hold an object firmly or securely.

Anchor Point: As used in this disclosure, an anchor point is a location to which a first object can be securely attached to a second object.

Auger: As used in this disclosure, an auger is a tool with a helical or screw type bit that is used for boring holes in objects.

Balloon: As used in this disclosure, a balloon is a flexible bladder that expands in volume when storing a pressurized gas. A balloon is further defined with an envelope and a throat. The envelope is the structural barrier of the balloon within which the pressurized gas is contained. The throat is a passage through which the pressurized gas is introduced into the balloon.

Bladder: As used in this disclosure, a bladder is fluid impermeable structure. The internal volume of the structure can be varied by: a) varying the pressure and/or quantity of a fluid contained within the bladder; or b) varying the quantity of a liquid contained within the bladder. Bladders are commonly used for the storage of a fluid and as a cushion.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Mass: As used in this disclosure, the center of mass refers to a point within a structure wherein a force applied to the point will cause the structure to move without rotation. The center of mass is commonly, but not always, the first moment of the structure normalized by the mass of the structure. While there are technical differences, the center of gravity of an object can be considered a synonym for the center of mass when the object is contained within the atmosphere of the Earth.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Composite Prism: As used in this disclosure, a composite prism refers to a structure that is formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Compressed Gas: In this disclosure, compressed gas refers to a gas that has been compressed to a pressure greater than normal temperature and pressure.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Density: As used in this disclosure, density is a measured property of a structure that equals the mass of the structure divided by the volume of the structure. The term specific gravity is commonly used to compare the different densities of two different structure. The specific gravity is calculated as the ratio of the two densities of the two different structure.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Flat: As used in this disclosure, flat is a description that is applied to a structure. Specifically, flat means: a) the structure is a surface formed as a Euclidean plane; or, b) the structure is a disk-shaped object wherein the span of the length a perpendicular line drawn through the centers of the congruent ends of the disk-shaped object is less than or equal to 1% of the span of the length of the perimeter of a congruent end of disk-shaped object that forms the structure.

Fluid: As used in this disclosure, a fluid refers to a state of matter wherein the matter is capable of flow and takes the shape of a container it is placed within. The term fluid commonly refers to a liquid or a gas.

Foil: As used in this disclosure, a foil is a sheeting formed from a metal. Foils are flexible and are often used to cover a surface.

Force of Gravity: As used in this disclosure, the force of gravity refers to a vector that indicates the direction of the pull of gravity on an object at or near the surface of the Earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gas: As used in this disclosure, a gas refers to a state (phase) of matter that is fluid and that fills the volume of the structure that contains it. Stated differently, the volume of a gas always equals the volume of its container.

Ground: As used in this disclosure, the ground is a solid supporting surface formed by the Earth. The term level ground means that the supporting surface formed by the ground is roughly perpendicular to the force of gravity.

Helium: As used in this disclosure, helium (CAS 7740-59-7) refers to the element with atomic number 2 in the periodic table. The standard abbreviation for helium is He.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Interlock: As used in this disclosure, an interlock is a second mechanism that enables and disables the operation of a first mechanism. Generally, an interlock is used as a safety device.

Inertia: As used in this disclosure, the term inertia describes an object that is not under the influence of an accelerating force. By under the influence is meant that the velocity of the object maintains a constant speed and direction (i.e. the object is not under acceleration or deceleration).

Inertial Sensor: As used in this disclosure, an inertial sensor is a form of a force sensor that measures the change in the inertia of an object.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the Earth.

Metal: As used in this disclosure, a metal is an element that readily loses electrons or an alloy formed from a plurality of such elements. General properties of metals include, but are not limited to, the ability to conduct heat, conduct electricity, malleability, and the ability to be drawn into a wire. For the purposes of this disclosure, the term metal is assumed to include the transition metals (columns 3-12 of the periodic table) and aluminum, tin, and lead. The alkali metals (columns 1 of the periodic table) and the alkali earth metals (column 2 of the periodic table) are assumed to be excluded from this definition. In this disclosure, the preferred metal is aluminum.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Nitrogen: As used in this disclosure, nitrogen (CAS 7727-37-9) refers to the element with atomic number 7 in the periodic table. The chemical abbreviation for nitrogen is N2.

Normal Temperature and Pressure: As used in this disclosure, normal temperature and pressure refers to gas storage conditions corresponding to 20 degrees C. at 100 kPa (approx. 1 atmosphere). Normal temperature and pressure is often abbreviated as NTP.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Projectile: As used in this disclosure, a projectile refers to an object moves through the atmosphere or a vacuum.

Propel: As used in this disclosure, to propel means to apply a force that accelerates a projectile or a rocket.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

N-gon: As used in this disclosure, an N-gon is a regular polygon with N sides wherein N is a positive integer number greater than 2.

Reduction-Oxidation Reaction: As used in this disclosure, a reduction-oxidation reaction (also known as a redox reaction) is a chemical reaction involving the transfer of electrons between the reactants of the reaction.

Rocket: As used in this disclosure, a rocket is a projectile that is propelled while in motion. The term rocket is often applied to an object that is accelerated to a velocity that takes the object out of the atmosphere. The term rocket is often used as a generic description for a rapidly moving object.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Shell: As used in this disclosure, a shell is a structure that forms an outer covering intended to contain an object. Shells are often, but not necessarily, rigid or semi-rigid structures that are intended to protect the object contained within it.

Sphere: As used in this disclosure, a sphere refers to a structure wherein every point of the surface of the structure is equidistant from a center point.

Spherical Section: As used in this disclosure, a spherical section refers one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap. The term spherical section is also applied to a semi-spherical structure.

Spit: As used in this disclosure, a spit refers to a composite prism structure formed by the combination of a prism and a pyramid such that the apex of the pyramid forms a point capable of pushing through the surface of a second structure.

Stake: As used in this disclosure, a stake is a shaft that is driven into a horizontal surface, such as the ground, to serve as an anchor point.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tarpaulin: As used in this disclosure, a tarpaulin is a protective covering made of a sheeting. The sheeting can be a textile material made from made from fibers or yarns suitable for textile production methods including, but not limited to, weaving, knitting, or felting. The sheeting can also be made of material in the form of a continuous film including, but not limited to, plastic films and metal foils.

Wire: As used in this disclosure, a wire is a structure with the general appearance of a cord or strand but that: 1) may not have the tensile or compressive characteristics of a cord; and, 2) is made from an electrically conductive material.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A fire extinguishing tarpaulin comprising a fire tarpaulin, a rocket system, and an aircraft;

wherein the fire extinguishing tarpaulin is configured for use extinguishing a chemical combustion reaction in an area of conflagration;

wherein the fire tarpaulin forms a gas impermeable barrier that limits the chemical combustion by limiting access to the oxygen required to sustain the chemical combustion reaction;

wherein the rocket system is a propulsion system that propels the fire tarpaulin to the chemical combustion reaction;

wherein the aircraft is a vehicle used: a) as a launching platform to deliver the fire tarpaulin to the chemical combustion reaction; and, b) a vehicle to subsequently recover the fire tarpaulin;

wherein the fire tarpaulin comprises a master sheeting, a plurality of anchors, a plurality of anchor cords, and a recovery structure;

wherein the plurality of anchor cords and the recovery structure attach to the master sheeting;

wherein the plurality of anchor cords attach the plurality of anchors to the master sheeting;

wherein the plurality of anchors comprises a collection of individual anchors;

wherein each individual anchor is a mechanical structure;

wherein each individual anchor is identical;

wherein each individual anchor lands on the ground;

wherein the individual anchor rotates to a previously determined orientation relative to the ground;

wherein the individual anchor discharges an auger that anchors the individual anchor to the ground;

wherein the anchor cord selected from the plurality of anchor cords that is associated with the individual anchor anchors a weighted sphere to the ground.

2. The fire extinguishing tarpaulin according to claim 1 wherein the fire tarpaulin is a mechanical structure;

wherein the fire tarpaulin is formed from non-combustible materials;

wherein the rocket system transports the fire tarpaulin to the location of the chemical combustion reaction;

wherein the fire tarpaulin forms gas impermeable barrier over the chemical combustion reaction.

3. The fire extinguishing tarpaulin according to claim 2 wherein the aircraft is a mechanical structure;

wherein the rocket system is a mechanical structure;

wherein the rocket system is the propulsion system that propels the fire tarpaulin to the site of the chemical combustion reaction.

4. The fire extinguishing tarpaulin according to claim 3 wherein the rocket system comprises a rocket launcher and a plurality of propulsion devices;

wherein the rocket launcher is a mechanical structure;

wherein the aircraft contains the rocket launcher;

wherein the rocket launcher contains the fire tarpaulin and the plurality of propulsion devices;

wherein the rocket launcher aims the fire tarpaulin and the plurality of propulsion devices at the chemical combustion reaction;

wherein the rocket launcher discharges the fire tarpaulin and the plurality of propulsion devices from the aircraft;

wherein each of the plurality of propulsion devices attaches to the fire tarpaulin;

wherein each of the plurality of propulsion devices provides a motive force that accelerates the fire tarpaulin towards the chemical combustion reaction after the fire tarpaulin and the plurality of propulsion devices have been discharged from the aircraft;

wherein the plurality of propulsion devices is a mechanical device that discharges a propellant used to accelerate the fire tarpaulin towards the chemical combustion reaction.

5. The fire extinguishing tarpaulin according to claim 4 wherein the fire tarpaulin is a self-anchoring structure;

wherein by self-anchoring is meant that the fire tarpaulin anchors itself to the ground such that the position of the fire tarpaulin remains fixed.

6. The fire extinguishing tarpaulin according to claim 5 wherein the master sheeting is a flexible sheeting structure;

wherein the master sheeting is formed from a foil;

wherein the master sheeting is formed from aluminum;

wherein the master sheeting forms a gas impermeable barrier that inhibits the access of chemical combustion reaction to atmospheric oxygen.

7. The fire extinguishing tarpaulin according to claim 6 wherein the individual anchor comprises the weighted sphere, the auger, a compressed acceleration gas, an inertial sensor, and a brake plate;

wherein the weighted sphere forms a shell that contains the auger, the compressed acceleration gas, and the brake plate.

8. The fire extinguishing tarpaulin according to claim 7 wherein the weighted sphere is a spherical structure;

wherein the weighted sphere is a rigid structure;

wherein the density of the weighted sphere is not uniform throughout the volume of the spherical structure of the weighted sphere;

wherein the interaction between the force of gravity and the density variations within the weighted sphere cause the weighted sphere to rotate on the ground into a fixed orientation relative to the ground;

wherein the auger anchors the weighted sphere to the ground.

9. The fire extinguishing tarpaulin according to claim 8 wherein the weighted sphere comprises an auger barrel, a major spherical section, and a minor spherical section;

wherein the auger barrel is a cavity that is formed within the weighted sphere;

wherein the auger barrel has a prism-shaped structure;

wherein the position of the auger barrel is such that the center axis of the auger barrel aligns with both the center of the spherical structure of the weighted sphere and with the center of mass of the minor spherical section.

10. The fire extinguishing tarpaulin according to claim 9 wherein the auger barrel contains the auger;

wherein the auger barrel contains the compressed acceleration gas;

wherein the auger barrel contains the inertial sensor;

wherein the brake plate mounts in the auger barrel;

wherein the compressed acceleration gas propels the auger out of the auger barrel.

11. The fire extinguishing tarpaulin according to claim 10 wherein the major spherical section is a spherical section formed in the weighted sphere;

wherein the major spherical section is further defined with a first density;

wherein the minor spherical section is a spherical section formed in the weighted sphere;

wherein the minor spherical section is matched to the major spherical section such that the major spherical section and the minor spherical section combine to form the full weighted sphere;

wherein the minor spherical section is further defined with a second density.

12. The fire extinguishing tarpaulin according to claim 11 wherein the second density of the material that forms the minor spherical section is greater than the first density of the material that forms the major spherical section;

wherein the density difference between the materials that form the major spherical section and the minor spherical section are selected such that the force of gravity will rotate the weighted sphere into the proper orientation;

wherein the proper orientation of the weighted sphere is set such that a line through both from a center of the weighted sphere and a center of mass of the minor spherical section will be parallel to the force of gravity.

13. The fire extinguishing tarpaulin according to claim 12 wherein the auger is a helical structure;

wherein the auger is a rotating structure;

wherein the auger is propelled out of the auger barrel of the weighted sphere into the ground;

wherein the compressed acceleration gas is compressed nitrogen;

wherein the compressed acceleration gas mounts in the auger barrel of the weighted sphere such that the release of the compressed acceleration gas propels and rotates the auger out of the auger barrel;

wherein the inertial sensor is an interlock device;

wherein the inertial sensor forms a valve structure that interfaces the compressed acceleration gas with the auger;

wherein the brake plate is a mechanical structure that mounts within the auger barrel of the weighted sphere;

wherein the brake plate is a ring structure that is sized to allow an auger spit and an auger shaft to escape the auger barrel of the weighted sphere but that traps the tailfin structure within the auger barrel;

wherein the brake plate physically secures the auger after it has been deployed such that the auger anchors the weighted sphere to the ground;

wherein each of the plurality of anchor cords is a cord;

wherein there is a one to one correspondence between the plurality of anchor cords and the plurality of anchors;

wherein each of the plurality of anchor cords physically anchors the master sheeting into a fixed position by attaching the master sheeting to an anchor selected from the plurality of anchors;

wherein each of the plurality of anchor cords is a flexible structure formed from a metal wire;

wherein the recovery structure is a mechanical structure;

wherein the recovery structure attaches to the master sheeting;

wherein the recovery structure forms a structure that allows the aircraft to capture the fire tarpaulin.

14. The fire extinguishing tarpaulin according to claim 13 wherein the auger comprises the auger shaft, the auger spit, and a tailfin structure;

wherein the auger shaft is a prism-shaped structure;

wherein the auger shaft is a helical structure;

wherein the auger shaft forms a structure that removes material away from the auger spit as the auger is driven into the ground;

wherein the auger spit is a pyramid shaped structure;

wherein the auger spit attaches to a congruent end of the auger shaft to form a composite prism structure;

wherein the combination of the auger shaft and the auger spit forms a spit structure that moves loose matter out of the way as the auger is driven into the ground by the compressed acceleration gas;

wherein the auger and the spit are defined elsewhere in this disclosure;

wherein the tailfin structure is a mechanical structure that forms an airfoil;

wherein the tailfin structure attaches to the congruent end of the auger shaft that is distal from the auger spit;

wherein the tailfin structure attaches the auger shaft to the inertial sensor;

wherein the release of the compressed acceleration gas rotates the tailfin structure to rotate the auger as the compressed acceleration gas drives the auger into the ground.

15. The fire extinguishing tarpaulin according to claim 14 wherein the recovery structure comprises a recovery cord and a balloon;

wherein the balloon attaches to the recovery cord such that the balloon elevates the recovery cord above the master sheeting.

16. The fire extinguishing tarpaulin according to claim 15 wherein the recovery cord is a cord that attaches across the face of the master sheeting;

wherein the recovery cord is formed from a metal wire;

wherein the balloon is a flexible bladder structure;

wherein the balloon forms a floating structure within the atmosphere.

17. The fire extinguishing tarpaulin according to claim 16 wherein the balloon further comprises an aluminum sheath, a lift cord, and a compressed lift gas;

wherein the aluminum sheath is a bladder;

wherein the aluminum sheath contains the compressed lift gas under pressure during the recovery process;

wherein the aluminum sheath forms a floating structure within the atmosphere such that the aluminum sheath provides the motive forces necessary to raise the recovery cord above the master sheeting;

wherein the lift cord is a cord;

wherein the lift cord is formed from a metal wire;

wherein the lift cord physically attaches the aluminum sheath to the recovery cord;

wherein the compressed lift gas is a compressed gas;

wherein the compressed lift gas is stored under pressure in the aluminum sheath.

18. The fire extinguishing tarpaulin according to claim 17 wherein the plurality of anchors further comprises a first anchor, a second anchor, a third anchor, and a fourth anchor;

wherein the first anchor attaches to the perimeter of the master sheeting;

wherein the second anchor attaches to the perimeter of the master sheeting;

wherein the third anchor attaches to the perimeter of the master sheeting;

wherein the fourth anchor attaches to the perimeter of the master sheeting.

* * * * *